United States Patent [19]

Delaage

[11] 3,971,905

[45] July 27, 1976

[54] SWITCH FOR A PRINTED OR LIKE CIRCUIT

[75] Inventor: Jacques Delaage, Paris, France

[73] Assignee: Societe d'Etudes et de Construction de Materiel Electronique - S.E.C.M.E., Paris, France

[22] Filed: Mar. 12, 1975

[21] Appl. No.: 557,577

[30] Foreign Application Priority Data

Mar. 20, 1974 France ..... 74.09422

[52] U.S. Cl. ..... 200/77; 200/153 L; 200/277; 200/67 AA

[51] Int. Cl.[2] ..... H01H 15/18

[58] Field of Search ..... 200/153 L, 77, 277, 200/67 AA, DIG. 29, 76, 282, 255

[56] References Cited

UNITED STATES PATENTS 2,521,468 9/1950 Lodge ..... 200/77

3,221,115 11/1965 Feher, Jr. ..... 200/77

*Primary Examiner*—Herman Hohauser

*Attorney, Agent, or Firm*—Oldham & Oldham Co.

[57] ABSTRACT

The switch has two metal contact strips projecting upwardly from the bottom wall of the housing and connected to two pins which extend out of the housing. A rectilinear slideway parallel to the end wall contains a slide of electrically insulating material which is movable in the slideway between a first position and a second position. The slideway has an aperture in the region of the contact strips and the slide has a cavity which contains a freely rotatable contact roller and has confronting lateral surfaces which urge the roller to a position for interconnecting the contact strips in said first position of the slide and an inoperative position of rest in said second position of the slide. A spring wire supported in the slide biases the roller out of the cavity toward the contact strips.

12 Claims, 4 Drawing Figures

SWITCH FOR A PRINTED OR LIKE CIRCUIT

The present invention relates to a switch, in particular for printed circuit, which may constitute an off-on switch or a current reversing switch which is simple, cheap and particularly reliable in operation.

Such a switch for a printed or like circuit comprises disposed within a housing: at least two metal contact means in projecting relation with respect to an end wall of the housing and connected to outer pins, a rectilinear slideway parallel to the end wall of the housing and provided with an opening in the region of the metal contact means, in which opening there is movable a flat slide of electrically insulating material comprising on one of its surfaces an actuating means accessible from outside the housing and in its opposite surface a cavity for housing a contact roller which is free to rotate but is elastically biased outwardly, the roller being driven laterally by the displacement of the slide so as to come selectively in contact with at least two of said metal contact means.

The switch is of the type described in U.S. Pat. No. 2,521,468. However, this switch has considerable drawbacks related to the complex shape of the elastically yieldable means which applies the contact roller against the metal contact means. Indeed, in this switch, the slide has an arcuate cavity whose wall does not directly act on the contact roller. The latter cooperates with a spring which must transmit elastically the movements of the slide to the contact roller and which has an arcuate median portion and two end portions which are alternately urged by the active faces of the slide.

This switch must have a well-determined shape and be very precisely calibrated, which requires a very careful manufacture. This is the more troublesome as the dimensions of the switch are smaller. For example, it may be mentioned that the switch according to the invention can have a housing whose dimensions are 10 × 5 × 7 mm. For such dimensions it is therefore desirable that the elastically yieldable means be as simple as possible.

According to the invention, there is provided a switch wherein the cavity of the slide has two confronting lateral surfaces disposed on each side of the contact roller and adapted to come selectively in contact with the contact roller so as to urge it into one or the other of its positions, and a spring held stationary in said slide acts on said roller so as to bias it outwardly of said cavity.

With these features it is possible to employ an extremely simple elastically yieldable means and preferably a portion of a spring wire which requires no particular machining operation.

According to a preferred embodiment, the switch comprises inside the housing a longitudinal partition wall which divides it into two identical compartments and supports on each of its opposite faces a guide slideway and a switching system.

Preferably, the cavity of the slide is eccentric and an aperture formed in the partition wall allows the passage of a pin for interconnecting the two slides. The two slides may be mounted in a symmetrical manner with respect to the partition wall or in opposite directions without resulting in a modification of the other parts of the switch. The switch may perform the function of a current reversing switch or an off-on switch, depending on whether the slides are mounted in the same direction or in opposite directions. It will be understood that the connecting pin may be dispensed with, the two slideways being then controlled idependently irrespective of their relative positions.

In this way there is obtained with identical parts merely by a different assembly, several types of switches whose shapes and outside dimensions are identical and which may be easily mounted on printed circuit boards or on conventional connectors.

The following descriptions of embodiments of the invention, given merely by way of example and shown in the drawings, will show the advantages and features of the invention.

Figure 1:
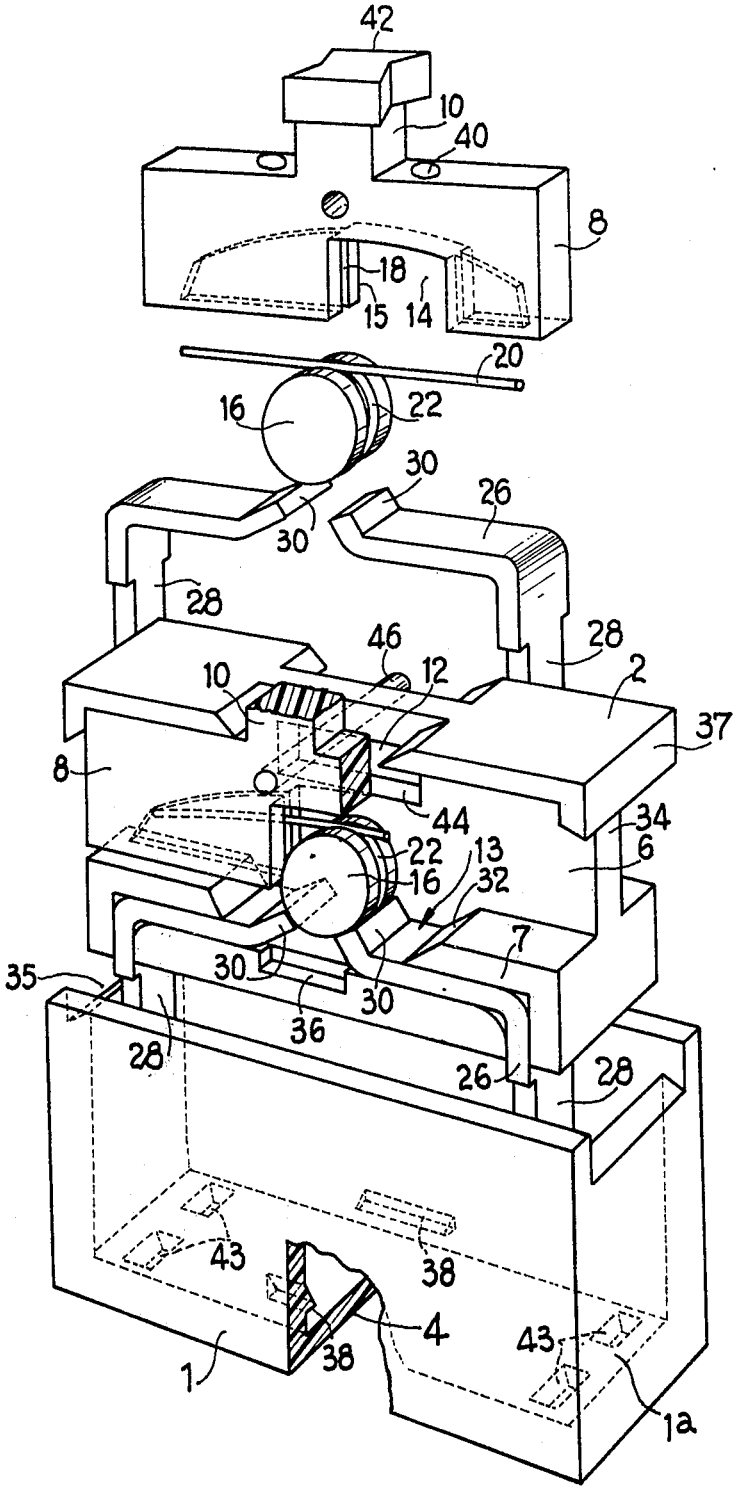
FIG. 1 is an exploded view of a double switch according to the invention.

The switch shown in FIG. 1 comprises a housing 1 of electrically insulating material open at one end and provided with a detachable cover 2 and an end wall 4. Disposed inside this housing is a longitudinally extending slideway 6 defined by the cover 2 and a bar 7 parallel to the latter and to the end wall 4. Slidable along the slideway 6 is a slide 8 which is provided on its surface facing the cover with a control button 10 extending through a slot 12 formed in the cover and projecting outwardly of the housing. Opposed to this slot the bar 7 is also provided with an aperture 13 and the slide 8 has a cavity 14 whose two opposite surfaces 15 come alternately in contact with a contact roller 16 of a material which is a good conductor of electricity, this roller being free to rotate in this cavity. On each side of the cavity 14 the slide 8 is also provided with a slot 18 which is parallel to the plane of the displacement of the slide and is extended inwardly to the level of the end of this cavity but whose depth in the vicinity of this cavity exceeds that of its end. Mounted in this slot is a filament or wire spring 20 which extends through the cavity 14 and bears against a groove 22 in the periphery of the roller 16 so that it biases the roller outwardly of the cavity 14 in the direction of the aperture 13.

Held stationary in the bar 7 are two identical metal strips 26 which are symmetrical with respect to the transverse axis of the aperture 13 and are connected outside the housing to pins 28. These strips 26 are folded inwardly of the housing in the aperture 13 in the direction of the slide and form two contact terminals 30. The spacing between these two terminals 30 is very distinctly less than the diameter of the roller 16 so that these two terminals constitute bearing surfaces for the roller when the transverse planes of symmetry of the cavity 14 and of the aperture 13 coincide.

On each side of the terminals 30 the wall of the aperture 13 is beveled in the form of an abutment 32 which defines with the terminals 30 a substantially V-sectioned recess whose dimension is such that the roller 16 can enter therein when the slide 8 moves and brings the cavity 14 in alignment with this recess. The spring 20 blocks the roller between the terminal 30 and the abutment 32.

Indeed, when the slide 8 moves in the slideway 6, the contact of the walls 15 of the cavity 14 with the roller 16 causes the latter to move laterally with the slide.

Figure 2:
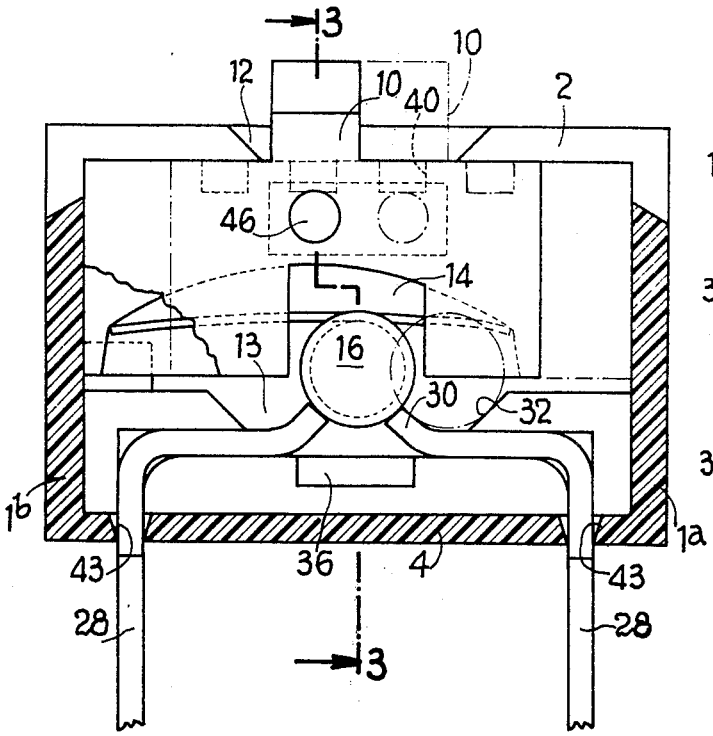
FIG. 2 is a front elevational view of the switch shown in FIG. 1 with the outer wall of the housing cut away.

When the latter slides between the position in full line in FIG. 2, in which the cavity 14 is facing the terminals 30, and a lateral position in dot-dash line in which this cavity 14 is in front of a V-shaped recess (that on the right side as viewed in the drawing), the roller 16 rolls over the terminal 30, which it passes over, but is stopped by the abutment 32 and thus moves from the position shown in the drawing, in which it bears against the two terminals 30 and closes the electric circuit between the pins 28, to a position of rest in which it is blocked between the terminal 30 it has rolled over and the corresponding abutment 32 in which position of rest the circuit between the two pins 28 is open. In these two positions, the roller 16 is maintained in intimate contact with the two terminals 30, or only one thereof, by the spring 20 which prevents it from accidentally rolling over the neighbouring terminal.

Preferably, the dimensions of the slide 8 are such that in each one of its positions, it is in contact with one of the opposed lateral walls $1^a$, $1^b$ of the housing (FIG. 2). The cavity 14 is then eccentric with respect thereto and with respect to the control button 10. The end walls of the slot 12 are beveled so that this slot is outwardly flared and the length of the slot is slightly greater than the travel of the slide. Thus the movement of the slide is limited by its abutment against the housing and this occurs before the control button can come in contact with the end of the slot.

Preferably, the lateral walls $1^a$ and $1^b$ of the housing 1 are provided in their upper part with notches 35 whose edge is beveled. The cover 2 then has a flange 37 whose end is inclined in a corresponding manner so that it exactly fits in the housing. Likewise, the bar 7 is provided with notches 36 in which there are fitted lugs 38 integral with the lower part of the longitudinal walls of the housing so that the different parts are locked to each other without use of any additional means. The housing is closed tight and the position of the roller cannot be seen from the outside. Also, the slide 8 is preferably provided on its upper face with two points 40 on each side of the button 10 which receive different colours. For example, one of these points is coloured in red and the other is uncoloured. A single one of these points appears in the slot 12 so that it is possible to know immediately the position of the roller with respect to the terminals. In practice, these points are recesses in the face of the slide.

Further, as the switch is intended for printed or like circuits and therefore has very small dimensions, the button 10 is provided with a head 42 whose two opposed end walls are recessed in the form of a V, the apices of these two V-shaped recesses facing each other. Each of these V-shaped recesses defines with the inclined wall of the slot 12 a passage in which may be introduced a control point, for example the point of an inspection measuring plug.

Note that the end wall 4 has apertures 43 for the passage of the pins 28, these apertures being outwardly convergent and having a dimension very slightly less than the perimeter of these pins. The latter are thus an interference fit or a drive fit in the apertures 43 so that the switch is sealed. This sealing is desirable in order to avoid entry not only of dust into the switch but also any soldering residues formed when the external connections are made with the pins 28.

Figure 3:
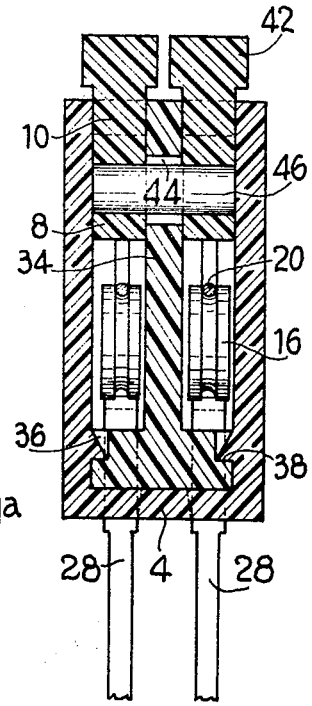
FIG. 3 is a sectional view taken on line 3—3 of FIG. 2.

In a preferred embodiment shown in FIGS. 1 to 3, the cover 2 and the bar 7 are rendered integral with each other by a longitudinal partition wall 34 which divides the housing 1 into two equal parts. On each side of this partition wall there is formed a slideway 6 in which is movable a slide 8 and a contact roller 16. The cover 2 is provided with two similar slots 12 and the end wall 4 of the housing has two pairs of pins 28 extending therethrough each one of these pairs being connected to two terminals 30 which are symmetrical with respect to the transverse plane of the housing.

The two slides 8 are identical and mounted the same way round so as to be disposed symmetrically with respect to the partition wall 34. In the position for closing the circuit between the two terminals 30, there are both in abutment against the wall $1^b$ of the housing and the two buttons 10 are at the corresponding end of the slot 12. The housing 1 therefore contains two switches which may be controlled independently and which are each connected to a pair of pins 28. These pins may be part of the same electric circuit or two different circuits.

Figure 4:
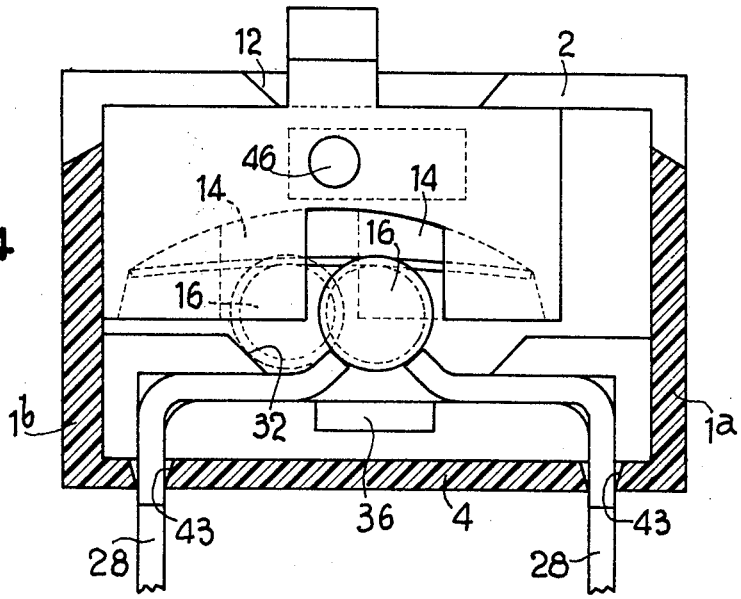
FIG. 4 is a view similar to FIG. 2 of a modification of the switch.

However, the partition wall 34 is provided with an aperture 44 which may be traversed by a pin 46 fixed in the two slides so as to render the latters integral with each other. The two slides are then actuated simultaneously and in the same direction. In this case, the switch performs the function of a bi-pole switch apparatus. However, the two slides having the cavities 14 which are eccentric may be mounted in opposite directions on each side of the partition wall 34 as shown in FIG. 4. One of the slides has its cavity in position for closing the circuit when it is in abutment against the wall $1^b$ whereas the other is in the closing position when it is in abutment against the wall $1^a$. Now, the two slides 8 are preferably connected by the pin 46 so that they are on the same side of the housing and their buttons 10 are located at the same end of the corresponding slot. They are therefore bearing against the same lateral wall $1^a$ or $1^b$ of the housing and one of the rollers 16 is in the position of rest between the terminal 30 and the abutment 32 on the left side of FIG. 4.

Any displacement of either of the buttons 10 causes a movement of the two slides and closes the previously-open circuit and opens the previously-closed circuit, that is to say the switching is reversed. This reversing switch comprises exactly the same parts as the off-on switch. A simple difference of assembly of the slides inside the housing has changed the operation of the switch. The other stages of manufacture are the same and the outside appearance of the switch is identical so that it is adaptable in the same way to the printed or like circuits.

In order to avoid errors, the housings have different colours depending on the functions of the switch. For example, the double off-on switch is coloured red or grey, depending on whether the two slides are independent or integral with each other and the reversing switch is coloured yellow. Thus it is easy to mount the appropriate switch on a printed circuit card or a connector.

Although the switch illustrated in the drawings has only a single partition wall 34 which divides the housing into two compartments, it will be understood that the switch according to the invention may have a plurality of similar partition walls dividing the housing into a large number of switching compartments. The slides of the various compartments are then either independent or all interconnected or connected in groups, or some of the slides are independent and the others are interconnected in various manners, dependent on the circuits.

However, it is possible to provide a modification of arrangement of multiple switches. It is possible to use double cavities as shown in the drawings and to mount them in a housing having a plurality of cavities therein each receiving one double unity, the cavities being coupled to one another in any desired manner. Such arrangement can thus be realized according to the standards of the integrated circuit techniques called "Dual in Line."

Having now described my invention what I claim as new and desire to secure by Letters Patent is:

1. A switch for a printed or like circuit comprising a housing having an end wall and, disposed inside the housing: two metal contact means in projecting relation to the end wall of the housing, pins extending out of the housing and respectively connected to said metal contact means, means defining a rectilinear slideway substantially parallel to the end wall of the housing and means defining an aperture in the slideway in the region of the metal contact means, a flat slide of electrically insulating material movable in the slideway in a plane and comprising on one side of the slide an actuating means accessible from outside the housing and in an opposite side of the slide means defining a cavity, a freely rotatable contact roller disposed in the cavity, a spring supported in the slide and engaging the contact roller for elastically biasing the roller outwardly of the cavity, the cavity of the slide having two confronting lateral surfaces located on opposite sides of the contact roller and capable of coming selectively in contact with the contact roller, one of the lateral surfaces contacting the contact roller and urging the contact roller to a position in which the contact roller interconnects said contact means when the slide is urged in one direction to a first position by the actuating means and the other of the lateral surfaces contacting the contact roller and urging the contact roller to a position of rest out of contact with said contact means when the slide is urged in an opposite direction to a second position.

2. A switch as claimed in claim 1, wherein the contact roller has a peripheral groove and defines a longitudinal slot which extends on each side of the cavity and is parallel to the plane of the movement of the slide, said spring being a filament which extends across said cavity and is engaged in the peripheral groove in the roller.

3. A switch as claimed in claim 1, wherein the aperture has confronting beveled edges which are downwardly inclined toward a median plan of the housing, the contact means comprising two strips which are substantially parallel to the end wall of the housing and have upwardly extending portions which extend into the aperture of the slideway and toward each other symmetrically with respect to the median plane of the housing and form two terminals which are spaced apart a distance distinctly less than the diameter of the roller and define with the corresponding beveled edges of the aperture substantially V-shaped recesses for locking the roller in said position of rest.

4. A switch as claimed in claim 1, wherein the actuating means comprise a button carried by the slide and defining a head having two opposed V-shaped recesses.

5. A switch as claimed in claim 1, wherein the cavity is offset relative to a median plane of the slide, the slide being in each of the first and second positions in abutment against lateral walls of the housing.

6. A switch as claimed in claim 1, wherein the slide has on each side of the actuating means a reference of different colour indicating the position of the roller relative to the metal contact means.

7. A switch for a printed or like circuit comprising a hollow housing having an end wall and, disposed inside the housing: a longitudinal partition wall which divides the housing into substantially identical compartments, means defining a rectilinear slideway substantially parallel to the end wall between the partition wall and the housing on opposite sides of the partition wall, a flat slide of electrically-insulating material disposed in and movable in a plane in each slideway, a pair of metal contact means in projecting relation to the end wall in each slideway, two pairs of pins extending out of the housing and respectively connected to each pair of contact means, means defining an aperture in each slideway in the region of the contact means, each slide having on one side of the slide an actuating means accessible from outside of the housing and in an opposite side of the slide means defining a cavity, a freely rotatable contact roller disposed in each cavity, a spring supported in each slide and engaging the contact roller for elastically biasing the roller outwardly of the cavity, each cavity having two confronting lateral surfaces located on opposite sides of the corresponding contact roller and capable of coming selectively in contact with the contact roller, one of the lateral surfaces contacting the contact roller and urging the contact roller to a position in which the contact roller interconnects said corresponding contact means when the corresponding slide is urged in one direction to a first position by the corresponding actuating means and the other of the lateral surfaces contact the contact roller and urging the contact roller to a position of rest out of contact with said corresponding contact means when the corresponding slide is urged in an opposite direction to a second position.

8. A switch as claimed in claim 7, wherein the partition wall has an aperture and a pin extends through said aperture in the partition wall and interconnects the two slides so that they operate together.

9. A switch as claimed in claim 8, wherein the two slides are mounted in a symmetrical manner on each side of the partition wall and simultaneously move to said first and second positions of the slides.

10. A switch as claimed in claim 8, wherein the two slides are mounted in opposite directions and their apertures are offset in the direction of movement of the slides with respect to each other so that the roller of one slide is in contact with the two terminals whereas the roller of the other slide is in said position of rest and the shifting of one of the actuating means reversing the two positions of the contact rollers.

11. A switch as claimed in claim 1, wherein the housing is in a colour indicating the function of the switch.

12. A switch as claimed in claim 1, wherein the end wall of the housing has apertures which are outwardly convergent and afford throughway passages in which the pins connected to said metal contact means are an interference fit.

* * * * *